US011000937B2

(12) United States Patent
Ali et al.

(10) Patent No.: US 11,000,937 B2
(45) Date of Patent: May 11, 2021

(54) ROTATABLE HEAD WITH ARBOR FOR USE WITH ABRASIVE ARTICLE

(71) Applicants: Terry Ali, Xenia, OH (US); Christopher Ali, Spring Valley, OH (US); Frank Ali, Xenia, OH (US)

(72) Inventors: Terry Ali, Xenia, OH (US); Christopher Ali, Spring Valley, OH (US); Frank Ali, Xenia, OH (US)

(73) Assignee: Ali Industries, LLC, Fairborn, OH (US)

( * ) Notice: Subject to any disclaimer, the term of this patent is extended or adjusted under 35 U.S.C. 154(b) by 0 days.

(21) Appl. No.: 16/556,882

(22) Filed: Aug. 30, 2019

(65) Prior Publication Data

US 2021/0060732 A1 Mar. 4, 2021

Related U.S. Application Data

(63) Continuation-in-part of application No. 29/702,633, filed on Aug. 21, 2019, now Pat. No. Des. 880,545, and a continuation-in-part of application No. 29/702,018, filed on Aug. 16, 2019, now Pat. No. Des. 882,650, and a continuation-in-part of application No. 29/702,039, filed on Aug. 16, 2019, now Pat. No. Des. 876,502, and a continuation-in-part of application No. 29/702,063, filed on Aug. 16, 2019, and a continuation-in-part of application No. 29/702,077, filed on Aug. 16, 2019, now Pat. No. Des. 884,755.

(51) Int. Cl.

| | |
|---|---|
| ***B24B 23/02*** | (2006.01) |
| ***B24D 13/20*** | (2006.01) |
| ***B24D 15/02*** | (2006.01) |

(52) U.S. Cl.
CPC ..... *B24D 13/20* (2013.01); *B24B 23/02* (2013.01); *B24D 15/02* (2013.01)

(58) Field of Classification Search
CPC ..... B24D 13/20; B24D 15/02; B24B 23/02
See application file for complete search history.

(56) References Cited

U.S. PATENT DOCUMENTS

| | | | | |
|---|---|---|---|---|
| 3,081,584 A * | 3/1963 | Bullard | B24D 7/16 | 451/548 |
| 3,653,857 A * | 4/1972 | Field | B24D 13/20 | 451/490 |
| 3,872,630 A | 3/1975 | Ali | | |
| 5,637,033 A * | 6/1997 | Williams | B24B 45/006 | 411/389 |
| 6,142,858 A * | 11/2000 | Luedeke | B24B 45/006 | 451/342 |
| 6,945,863 B1 * | 9/2005 | Hettes | B24D 13/16 | 451/490 |

(Continued)

*Primary Examiner* — Dung Van Nguyen
(74) *Attorney, Agent, or Firm* — R. William Graham

(57) ABSTRACT

A rotatable head and arbor for use with abrasive parts includes a rotatable head and an arbor connected to the rotatable head at a central axis of a rotatable head, wherein an outward extending end of the arbor has a polygonal cross-sectional configuration. Another aspect of the invention is a rotatable head and arbor for use with abrasive articles includes a head which includes a polyfoam material and a rigid plate member formed into the polyfoam material and an arbor connected to the head at a central axis of the rotatable head.

4 Claims, 7 Drawing Sheets

(56) References Cited

U.S. PATENT DOCUMENTS

| | | | | |
|---|---|---|---|---|
| 7,121,924 | B2 * | 10/2006 | Fritz | B24D 7/16 451/28 |
| 9,272,393 | B2 | 3/2016 | Ali | |
| 2014/0265166 | A1 * | 9/2014 | Shaughnessy | B24B 45/006 279/143 |

* cited by examiner

3" Backer Pd with Hex Arbor

Drum Sander with Hex

3" Hex Arbor Stripping Pad
10'''
Hex Arbor
22'
Washer
42
Stripper Pad
50
Stripper Pad
50
Washer
42
Bolt
54

10'''
50
42
22'

10'''
22'
50

10'''
54
50

10'''
22'
50

ROTATABLE HEAD WITH ARBOR FOR USE WITH ABRASIVE ARTICLE

BACKGROUND OF THE INVENTION

1. Field of the Invention

The invention relates generally to the field of sanding devices. More particularly, but not way of limitation, the present invention relates to improvements in rotatable abrasive heads for power driven devices.

2. Related Art

Rotatable abrasive devices have been described in many different forms. There currently exist many types of sanding wheels, disks, flap wheels and stripping wheels. All of these prior devices use a form of arbor for attachment to the abrasive head in which to attach to a power drill or the like rotary device for use in providing a rotary sanding device. Conventional technology utilizes a cylindrical arbor which is fixed to the particular head in some manner, such as by way of an integral attachment.

While these devices have been of great use, there remains a need to improve upon the prior art devices. Such prior sanding device have not, however, evolved to meet needs of the user. For example, it is desirable to ease the use of such prior devices. Additionally, it is desirable to minimize fatigue to the user while maintaining the effectiveness of the abrasive device.

The inventor of the instant invention has attempted to provide improvements in the field through the making of a unique arbor attachment for such abrasive powered heads.

BRIEF SUMMARY OF THE INVENTION

It is an object of the invention to provide an ergonomically improved rotary powered abrasive device.

It is another object of the invention to enhance the ease of use of a rotary powered abrasive device while improving effectiveness of the same.

Another object is to provide the rotary powered abrasive devices with an improved arbor.

Still another object is to provide a rotary powered abrasive device with a foam back and unique support plate.

It is another object to provide a method of making a rotary powered abrasive device.

Another object is to provide a rotary powered abrasive device made from the method as described.

Accordingly, one aspect of the invention is directed to a rotatable abrasive head and arbor. In one embodiment, the rotatable abrasive head and arbor includes polygonal (preferably hexagonal) arbor connected at a central axis of a rotatable abrasive head. The hexagonal arbor is further characterized to be threadably connected to a central axial shaft extending outward generally perpendicular to a central plane which extends through the rotatable abrasive head. In another case, the hexagonal arbor is fixably connected to a central hub of the rotatable abrasive head.

In still another embodiment, there is provided a head which includes a polyfoam material and a rigid plate member formed into the polyfoam material. Additionally, the rigid plate member can have a plurality of peripheral recessed surfaces to receive a part of the polyfoam therein. This recess aids in maintaining the polyfoam material in place during use under significant rotational force, e.g., 6000 rpm. Without these recessed or notched portions, the poly foam tends to break apart. The rigid plate member can preferably be made of a metal material to lend weight as well as rigidity to a bottom sanding surface of the rotatable abrasive head. The rigid plate member nearly spans the diameter of a bottom surface of the head as it is preferably entirely encased within the polyfoam. Further, the rigid plate member can preferably be uniformly spaced from the bottom surface. The arbor can preferably include a rivet type connection with the rigid plate member, where the rivet type connection at a first end of the arbor and plate member are covered with the polyfoam material and a second end of the arbor extends outward from the polyfoam material for attachment to a power drill, for example. The second end is preferably formed with a hexagonal cross-sectional configuration.

Another feature is that the bottom surface can include one of a hook and loop material integrally formed on the bottom surface to enable connection of one of a complementary hook and loop material which can either in directly or indirectly connect an abrasive substrate. By way of illustration, the rigid member is spaced at least about an ⅛th inch from the bottom surface.

In the formation process, the polyfoam material between the rigid plate member and bottom sanding surface is generally more dense than the polyfoam material than above the plate member. One hook and loop member can preferably be integrally connected as part of the bottom surface during the head formation. In this regard, the hook and loop member is held in spaced relation to the rigid plate member during expanding and curing phases of the polyfoam material. By virtue of this configuration there is provided an improved rotatable abrasive head and arbor which reduces less fatigue to the person doing the sanding, and the sanding operation is performed in a more consistent and uniform manner to provide a smoother finish.

Another aspect of the invention is directed to forming a rotatable abrasive head and arbor of the invention. The method includes the steps of providing a first mold part having a first part forming surface defined by a first perimeter and a second mold part having a second part forming surface defined by a second perimeter which when the first and second perimeters are disposed adjacent one another with the first and second part forming surfaces facing one another there is defined a rotatable abrasive head forming inner surface cavity with an opening to receive the arbor. A hook material member is placed on a bottom surface of the head forming cavity. The rigid plate member is suspended and maintained in the cavity adjacent the hook material but not touching material or the head forming inner surface. A polyfoam liquid material is then delivered into cavity and allowing the polyfoam material to expand about the rigid member in a manner to enclose the rigid member substantially within the polyfoam material.

In a preferred embodiment, the rigid member includes a predetermined number of openings which are of a predetermined size and spatially positioned across its surface as a function of flow and expansion characteristics of the polyfoam material. Preferably, the polyfoam liquid is introduced onto the rigid member between a region which forms a bottom surface and is permitted to flow through the openings into the remainder of the cavity which forms an upper surface of the head. The method further includes disposing a hook and loop member adjacent the first mold part such that the polyfoam material is introduced between the rigid member and the hook and loop member, and the hook and loop member is maintained in fixed position relative to the rigid member during curing of the polyfoam material.

Other objects and advantages will be readily apparent to those skilled in the art upon reviewing the drawings and the detailed description which follows:

DETAILED DESCRIPTION OF THE INVENTION

Figure 1:
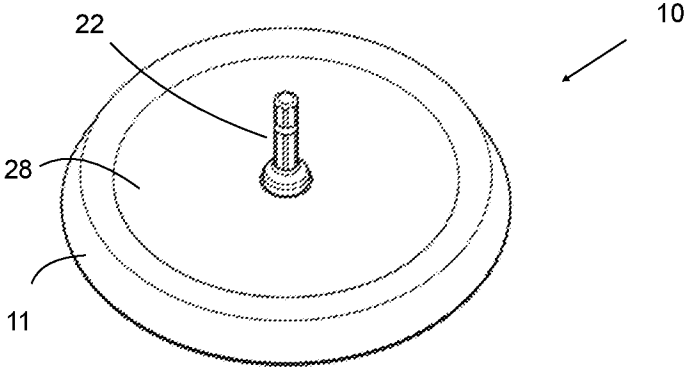
FIG. 1 is a perspective view of one embodiment of a rotatable abrasive head and arbor of the present invention.

Referring now to the drawings shown in FIGS. 1-24, the rotatable abrasive head and arbor of the invention is generally referred to by the numeral 10, 10', 10", 10'''. The term "rotatable abrasive head" used herein is contemplated to include sanding implements having various geometric configurations although the instant invention provides one herewith. For example, as will be discussed herein more fully, FIGS. 1-9 show a poly foam backer pad with abrasive bottom surface, FIGS. 10-14 show an abrasive flap wheel, FIGS. 15-19 show an abrasive drum sander, and FIGS. 20-24 show a stripper wheel. All of the embodiments are preferably equipped with a polygonal (preferably hexagonal) cross-sectional shaped arbor 12. Like numbers will be identify with like parts.

In the embodiment in FIGS. 1-9, the rotatable abrasive head and arbor 10 includes a bottom portion 12, an integrally formed rigid plate member 14 which can preferably be of a relatively substantial thickness, e.g., 1/16-1/8th inch, made of a metal material to lend weight as well as rigidity to a bottom surface 16 of the sanding head 11. The rigid member 14 preferably nearly spans the diameter of the bottom surface 16 being slightly less in diameter as it is preferably entirely encased within the polyfoam material 18.

Figure 2:
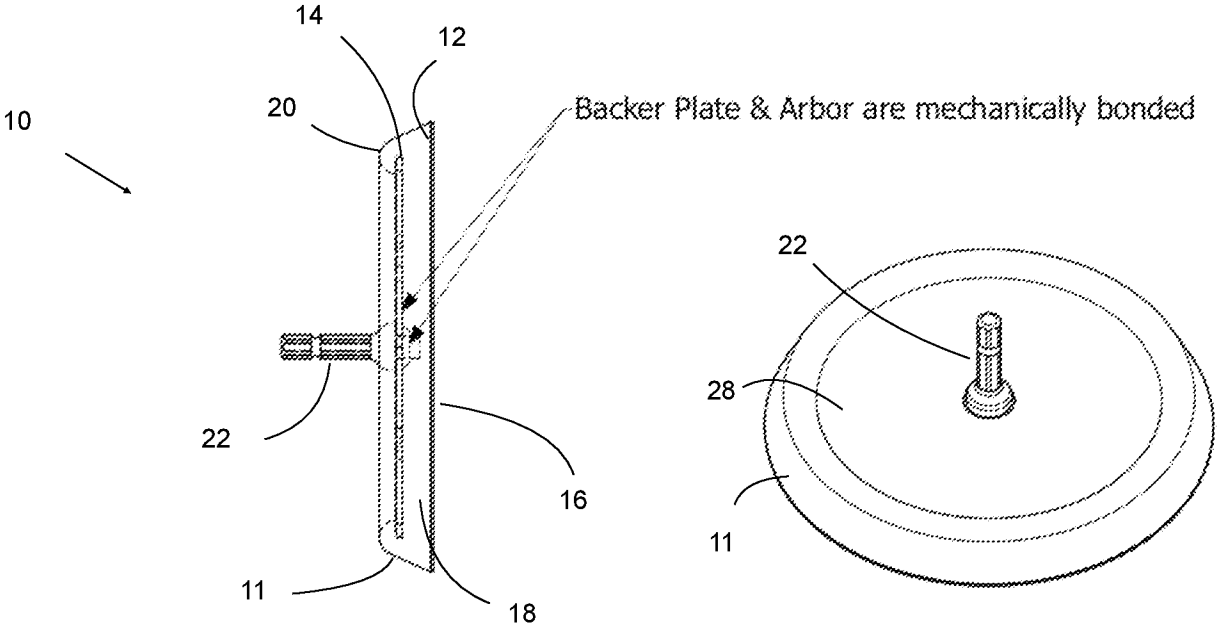
FIG. 2 is side view revealing inner components of the rotatable abrasive head of FIG. 1.
Figure 3:
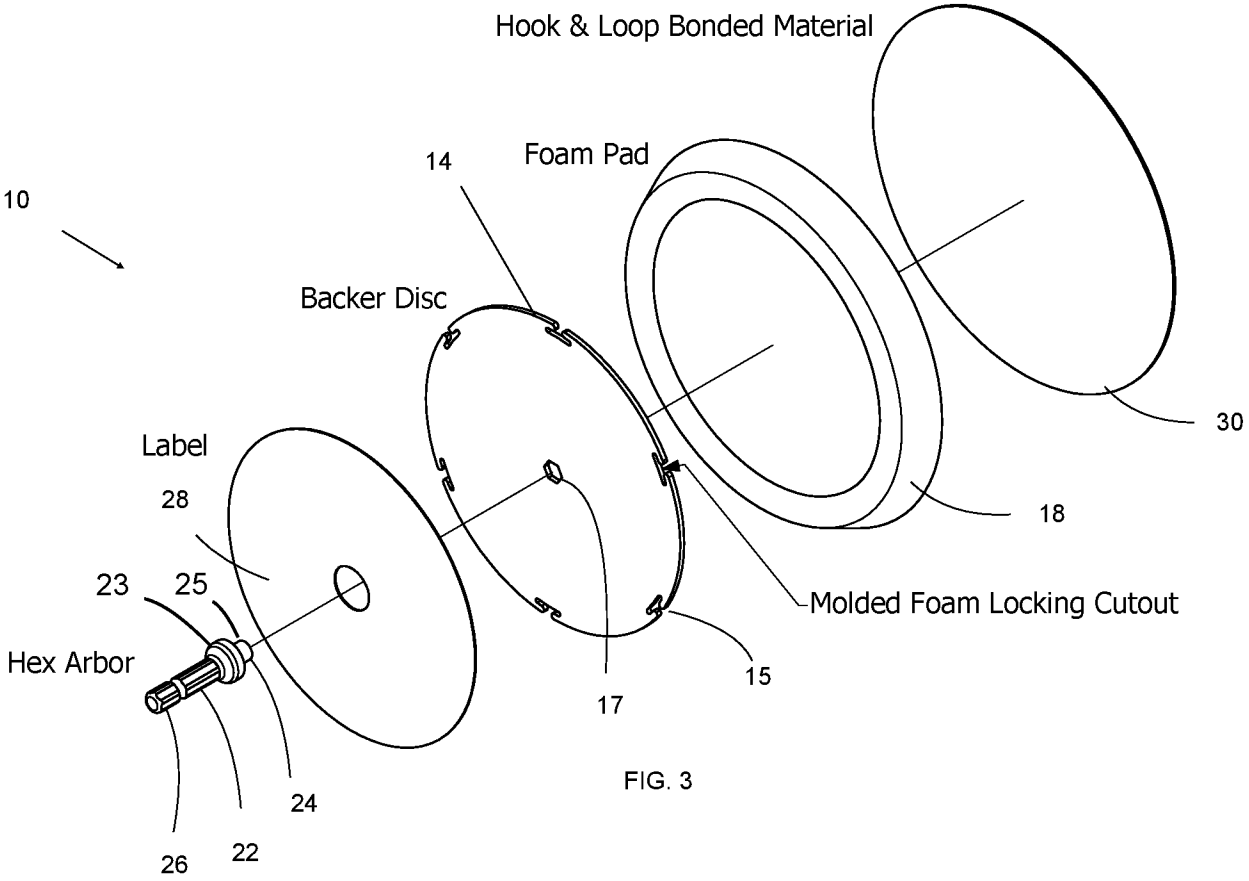
FIG. 3 is an exploded perspective view of the embodiment of FIG. 1.
Figure 6:
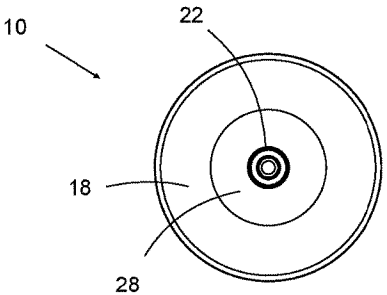
FIG. 6 is a top view of the FIG. 4.
Figure 7:
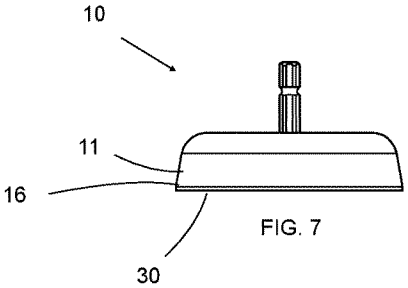
FIG. 7 is a side view of FIG. 4.
Figure 8:
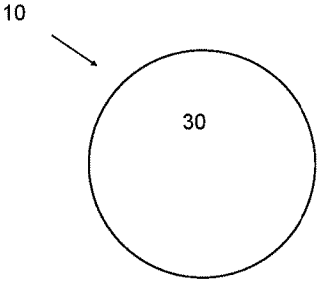
FIG. 8 is a bottom view of FIG. 4.
Figure 4:
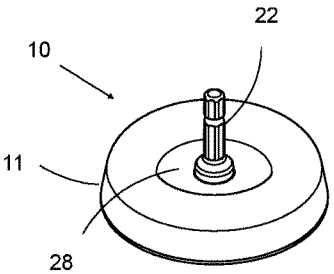
FIG. 4 is a perspective view of another embodiment of a rotatable abrasive head and arbor of the present invention.
Figure 5:
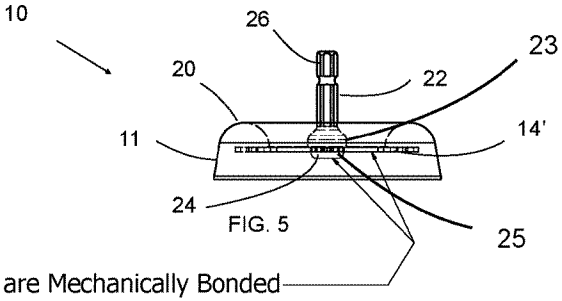
FIG. 5 is side view revealing inner components of the rotatable abrasive head of FIG. 4.
Figure 9:
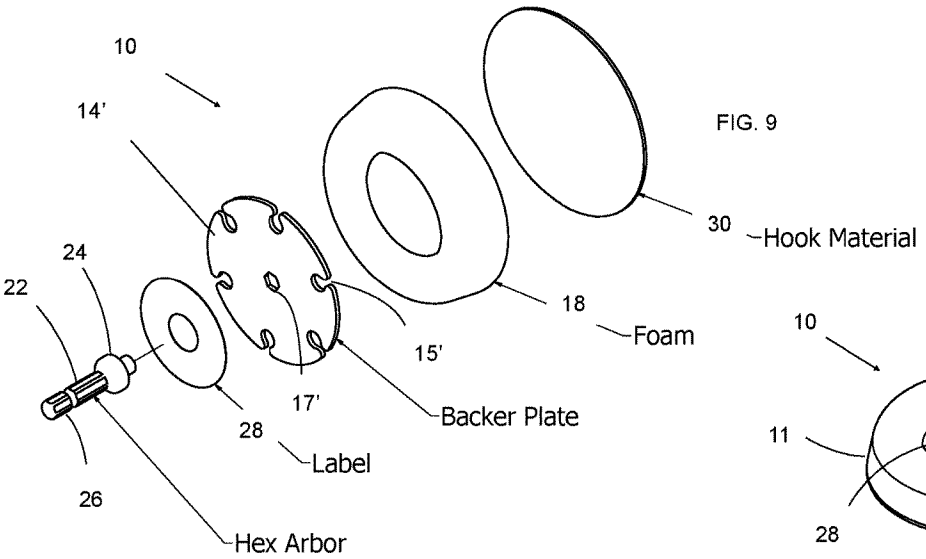
FIG. 9 is a top perspective view illustrating hidden components of the sanding block of the present invention.
Figure 10:
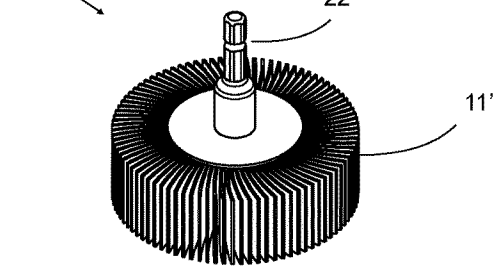
FIG. 10 is a perspective view of another embodiment of a rotatable abrasive head and arbor of the present invention.
Figure 11:
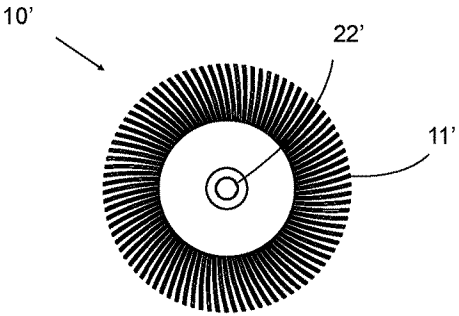
FIG. 11 is top view of the rotatable abrasive head of FIG. 10.
Figure 12:
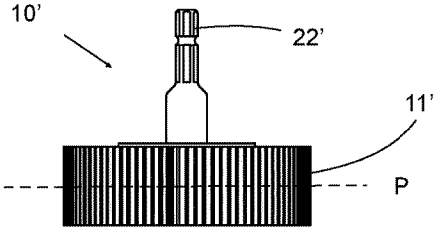
FIG. 12 is a side view of the FIG. 10.
Figure 13:
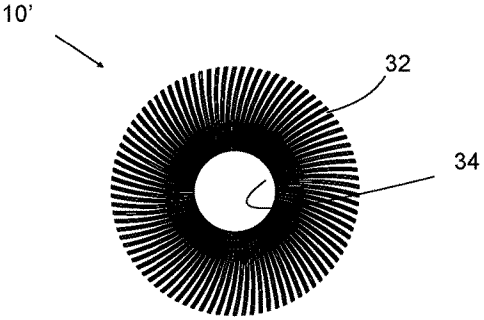
FIG. 13 is a bottom view of FIG. 10.
Figure 14:
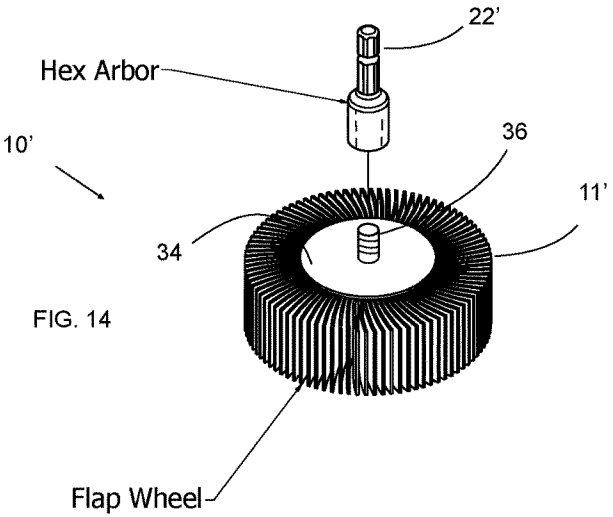
FIG. 14 is an exploded perspective view of the embodiment of FIG. 10.
Figure 16:
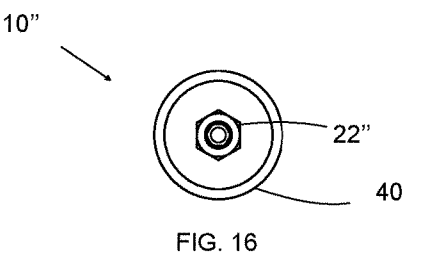
FIG. 16 is top view of the rotatable abrasive head of FIG. 15.
Figure 17:
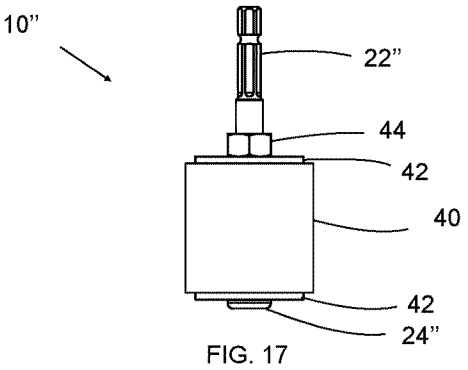
FIG. 17 is a side view of the FIG. 15.
Figure 18:
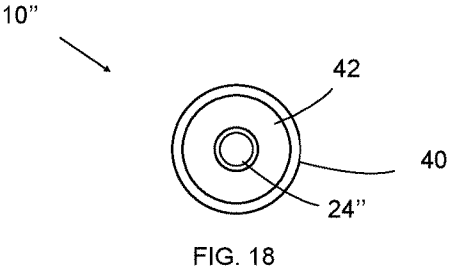
FIG. 18 is a bottom view of FIG. 15.
Figure 15:
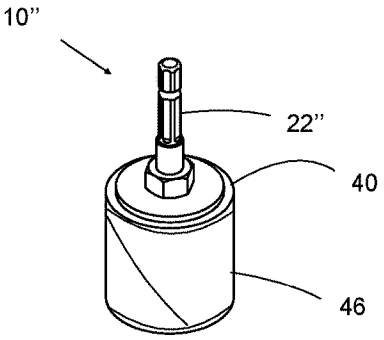
FIG. 15 is a perspective view of another embodiment of a rotatable abrasive head and arbor of the present invention.
Figure 19:
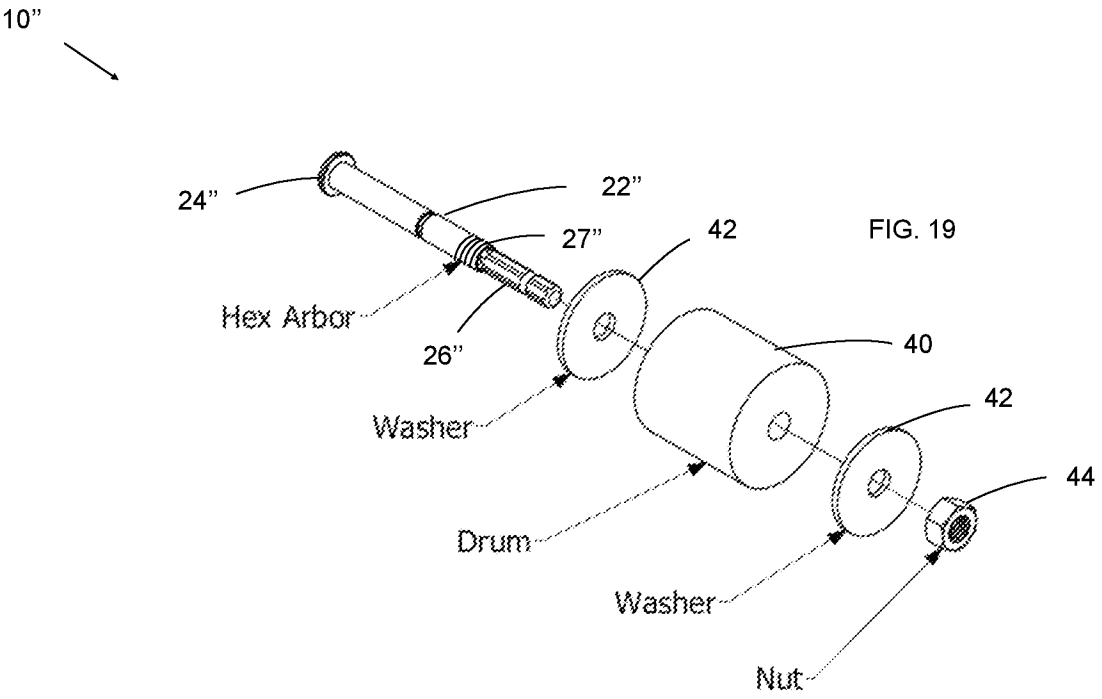
FIG. 19 is an exploded perspective view of the embodiment of FIG. 15.
Figures 20, 21, 22, 23, 24:
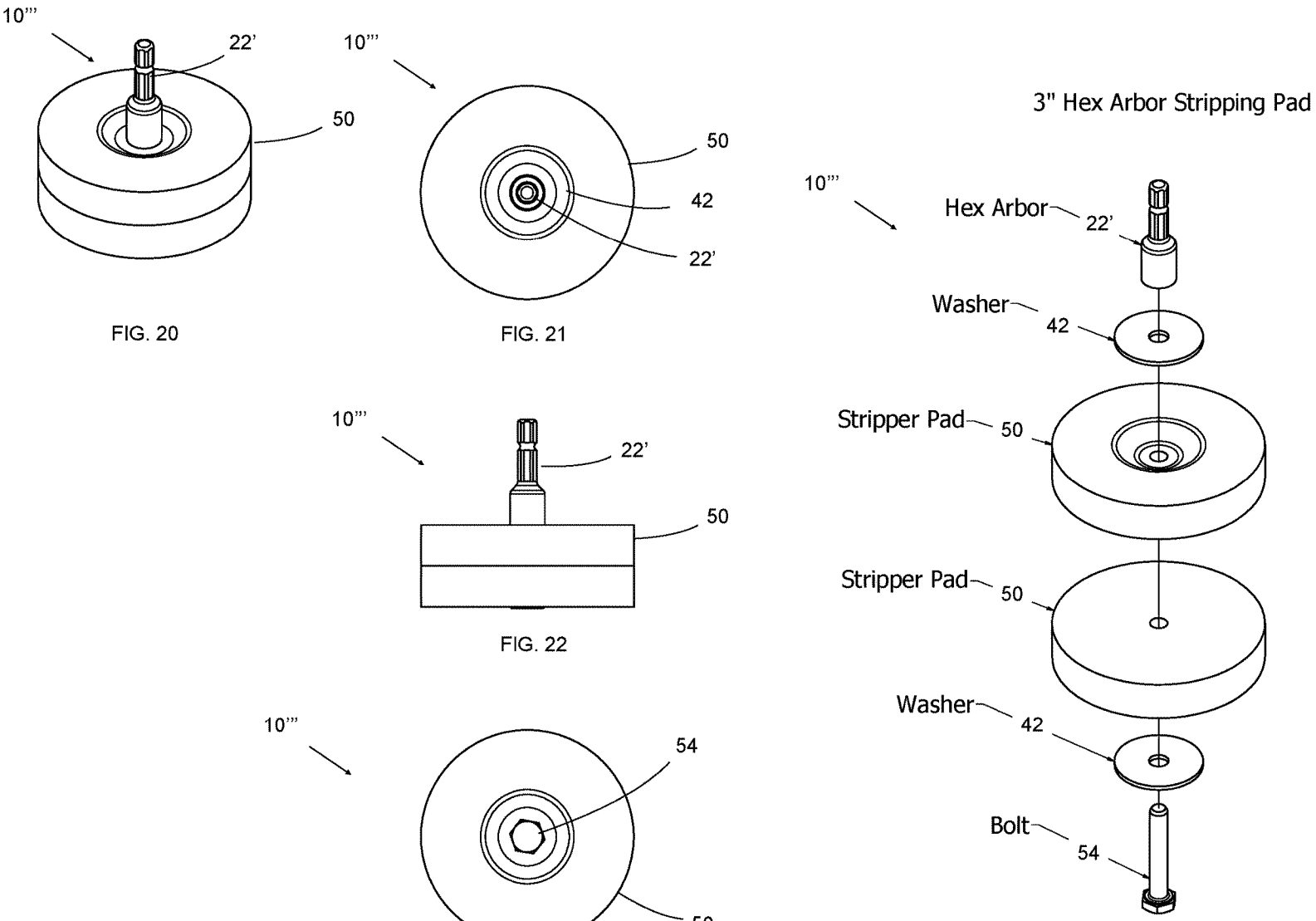
FIG. 20 is a perspective view of another embodiment of a rotatable abrasive head and arbor of the present invention.
FIG. 21 is top view of the rotatable abrasive head of FIG. 20.
FIG. 22 is a side view of the FIG. 20.
FIG. 23 is a bottom view of FIG. 20.
FIG. 24 is an exploded perspective view of the embodiment of FIG. 20.

As illustrated in FIG. 3 and FIG. 9, the rigid plate member 14, 14', referred to as a backer plate or disc, can preferably include a plurality of peripherally spaced recessed surfaces 15, 15', respectively, which provide molded foam locking cutouts. The rigid plate member 14, 14' is preferable uniformly spaced from the bottom sanding surface 16 as seen in FIG. 2 and FIG. 5. By way of illustration, the rigid plate member 14,14' can preferably spaced up to about 0.25 inch from the bottom sanding surface 16 to provide a sufficient coverage and in combination with the peripherally spaced recessed surfaces 15, 15' preclude delamination of the poly foam material 18 which would tend to occur under high torque and rotational speed. The rigid member 14,14' can preferably be made of a metal to lend the desired rigidity and density, however, other materials or combinations of plastic, metal or wood are contemplated to accomplish the weight and rigidity which is desired in the bottom portion 12.

An upper portion 20 of the rotary head 12 includes an arbor 22 which protrudes preferably from a central open surface 17, 17' of rigid plate member 14, 14' and from the polyfoam material 18. The central open surface 17, 17' includes at least two opposing surfaces, for example, a polygonal shape, which becomes part of a mechanical lock once the riveting process is complete as illustrated in FIG. 5. The arbor 22 can preferably include a rivet type connection with the rigid plate member 14, 14', where a rivet connection by stamping a first end 24 of the arbor 22 once inserted through central open surface 17, 17' of plate member 18 mechanically locks the two together and are then covered with the polyfoam material 18. The first end has an enlarged portion 23 and a neck 25 which passes through the central polygonal open surface 17, 17' and which upon stamping, the neck 25 deforms to fill central polygonal open surface 17, 17' and becomes enlarged at a terminal point to lock into place the arbor 22 and prevent rotational movement there between by virtue of contact with opposing surfaces of the central polygonal open surface 17, 17'. A second end 26 of the arbor 22 extends outward perpendicular to the rigid plate member 14, 14' and from the polyfoam material 18 for attachment to a power drill, for example. The second end 26 can preferably be formed with a hexagonal cross-sectional configuration. Additionally, a label 28 can be affixed on top of the rigid plate member 14, 14' and poly foam material 18.

The polyfoam material 18 is one in which two reactive liquid components, a polyol and an isocyanate, for example are metered, blended together, and introduced into a closed mold at low pressure. By virtue of the formation process as will be discussed hereinafter, the polyfoam material in region between the rigid member 14, 14' and bottom sanding surface 16 is generally more dense than the polyfoam material in the upper portion 20.

A hook and loop member 30 can preferably be integrally connected as part of the bottom surface 16 during the formation of the head 12. In this regard, the hook and loop member 30 is held in spaced relation to the rigid member 14 during expanding and curing phases of the polyfoam material 18. A complementary hook/loop member (not shown) can be connected to the hook and loop member 30 which can either have an external surface configured with an abrasive material or provide a surface suitable to receive sticky back abrasive sheets.

The design of the head 11, in weight and rigidity of the rigid member 14 and the inclusion of the arbor 22 are designed such that the user can interact most efficiently and safely to provide an improved sander. The construction of the head 10 reduces less fatigue to the person doing the sanding and the sanding operation is performed in a more consistent and uniform manner.

Another aspect of the invention is directed to forming a head and arbor 10 of the invention. The method includes the steps of providing a first mold part having a first part forming surface defined by a first perimeter and a second mold part having a second part forming surface defined by a second perimeter which when the first and second perimeters are disposed adjacent one another with the first and second part forming surfaces facing one another there is defined a cavity having an inner surface configured to form an outer surface of a head 11 which includes a bottom surface 16 and an opening for the arbor 22. The rigid plate member 14, 14' is suspended and maintained in the cavity by virtue of locating pins which include a collar upon which locating surfaces are seated to place the rigid member 14, 14' adjacent but not touching the inner surface.

The liquid components of polyfoam material are delivered into cavity which allows the polyfoam material to expand about the rigid plate member 14, 14' in a manner to enclose the rigid member 14, 14' and end 24 of arbor 22 substantially within the polyfoam material with sufficient coverage to prevent delamination (e.g., an ⅛th-¼ inch but deviations from this number are contemplated as providing a sufficient amount). The rigid plate member 14, 14' includes a predetermined number of openings 15, 15' which are of a predetermined size and spatially positioned across the periphery surface of the rigid plate member 14, 14' in accordance with flow and expansion characteristics of the polyfoam material L to enter through as well as around the periphery of the rigid plate member 14, 14'.

Preferably, the polyfoam liquid is introduced onto the rigid member 14, 14' as between in region which forms the bottom surface 16 and is permitted to flow through the openings 15, 15' into the remainder of the cavity which forms an upper surface 20 of the head 11. The method further includes disposing hook and loop member 30 adjacent the first mold part, i.e., bottom surface, such that the polyfoam material can be introduced between the rigid member 14, 14' and the hook and loop member 30 while the hook and loop member 30 is maintained in fixed position relative to the rigid member 14, 14' during expansion and curing of the polyfoam material. The head 11 is formed via a molding process, in which two reactive liquid components, a polyol and an isocyanate, for example are metered, blended together, and introduced into a mold parts at low pressure.

Here, the present invention is configured by inner head forming surface configured for forming the head 11. The there is operatively provided a feed mechanism which can be a nozzle including liquid components, e.g., isocyanate and polyol, feed lines, a pump and return line and another liquid component, exchanger and nucleator. The first forming surface is configured with flat surface to receive the hook and loop member 30 thereagainst. The rigid member 14, 14' and hook and loop member 30 are mechanically and adhered together by poly foam 18. The hook and loop member 30 includes enough porosity to be securely bonded and the rigid plate member 14, 14' is securely retained by enclosure from the polyfoam material 18.

Once the rigid plate member 14, 14' is in its respective position on collars suspending the same in position, the liquid L is supplied onto the rigid member 14, 14'. Due to the relatively short reaction time (10-15 seconds) the hook and loop portion 30 is disposed over the liquid and the mold parts secured.

The liquid material enters cavity which forms the shape of the head 11. Upon a reaction between the components, the polyfoam layer is formed which is bonded to the rigid member 14, 14' and hook and loop member 30. The method of making the head and arbor 10 can include amounts of the two components forming the polyfoam layer to aid in the control of a chemical reaction such that the components only permeate a portion of the hook and loop portion 30 through a surface facing the components as they react as well as sufficiently bond to and around the rigid member 14, 14'. In a preferred embodiment, the liquids include a polyol and an isocyanate which can be metered, blended together, and introduced thereafter at low pressure to form the polyurethane structural foam. By introducing the liquid L onto the rigid member 14, 14' in region between the rigid plate member 14, 14' and hook and loop member 30, the foam part contacting within region results in increased density compared to the remainder upper portion 20 of above the plate member 14, 14' which enters into cavity through holes 17, 17' and over edge of rigid plate member 14, 14'. This is preferred as the formed overall sanding block maintains a consistent rigid, flat bottom portion 12. Subsequent the reaction, the head and arbor 10 is removed from the mold and can be trimmed to provide a finished product.

After forming, an abrasive material, can be for example a sandpaper sheet which can have complementary the hook and loop member (Velcro) on a backing thereof or simply be a sticky back sandpaper to a complementary loop material with a flat backing to receive the sticky back sandpaper and thus provide the the rotatable abrasive head and arbor 10. The rotatable abrasive head and arbor 10 and method of making the same is exemplary of that contemplated by the inventor and it is contemplated that there can be a design changes to facilitate a particular use of the implement.

In this regard, FIGS. 10-14 disclose a rotatable abrasive head and arbor 10'. Here there is a flap wheel head 11' and arbor 22'. Here, the abrasive flaps 32 are joined to a central hub 34 from which on one side a threaded shaft 36 extends from the hub 34 perpendicular to a plane P which runs through the flap wheel head 11'. In this embodiment, the shaft 36 can be epoxied or otherwise fixed in the hub 34.

Still another embodiment is depicted in FIGS. 15-19. In this embodiment the rotatable abrasive head and arbor 10" is an abrasive drum type sander. The rotatable abrasive head and arbor 10" can include a rubber cylindrical member 40 which is flanked on its ends by washers 42 having central openings. Here the arbor 22" includes a first end 24" which includes a head 26" larger than central opening of washers 42 serving as a stop and second end 26", the remainder having less diameter than the central opening of the washers 42. The arbor 22" having a threaded portion 27" and a hexagonal cross section profile. A threaded nut 44 connects the and locks the arbor 22" in place on the drum 40. A cylindrical abrasive belt 46 can be disposed about the drum for sanding.

In yet another embodiment seen in FIGS. 20-24, there is provided a rotatable abrasive head and arbor 10'". The rotatable abrasive head and arbor 10'" includes stripper pad wheels 50 and arbor 22'. Similarly, stripper pad wheels 50 are flanked on outer sides by washers 42. Here, a threaded bolt 54 extends through the washers 42, stripper pad wheels 50 and threads to the arbor 22' to lock the parts in place.

By so providing, the instant invention enables the manufacture of improved rotatable abrasive head and arbor which offer desirable qualities in ease of use, consistent finish and durability than previously available. The above described embodiment is set forth to exemplify the invention and is in no way meant to limit the present invention. It will be readily apparent to those skilled in the art that various modifications, derivations and variations can be made in material and to structure without departing from scope or essence of the invention. Accordingly, the appended claims should be read in their full scope including any such modifications, derivations and variations.

What is claimed is:

1. A rotatable head and arbor for use with an abrasive article, which includes:

a rotatable head which maintains structure under rotational force up to 6000 rpm, wherein said rotatable head includes a rigid metal plate member having a central polygonal open surface extending entirely through said rigid plate member wherein said rigid plate member includes a plurality of peripherally spaced recessed surfaces;

an arbor connected to said rotatable head at a central axis of a rotatable head, having a first end said arbor has a polygonal cross-sectional configuration which remains exposed for connection, and a second end of said arbor having a neck which extends through said central open polygonal surface and which upon stamping, said neck fills said central polygonal open surface imparting a polygonal cross-sectional configuration complementary thereto and forms a mechanical lock with a rivet type connection to said rigid plate member; and a polyfoam material formed onto and about the rigid plate surface and said connecting end and into said peripherally spaced recessed surfaces and providing a continuous flat surface for removable attachment of an abrasive material.

2. The rotatable head and arbor of claim 1, wherein said rotatable head includes one of a hook and loop material integrally formed on a bottom surface of said head to enable connection of one of a complementary hook and loop material and abrasive substrate connected thereto.

3. The rotatable head and arbor of claim 1, wherein said rigid plate member is spaced up to about 0.25 inch from the bottom sanding surface to provide a sufficient coverage of said connecting end and in combination with said peripherally spaced recessed surfaces to aid in preventing delamination of said poly foam material.

4. The rotatable head and arbor of claim 1, wherein said poly foam includes polyol and isocyanate.

* * * * *